US007001225B2

(12) United States Patent
Horiuchi

(10) Patent No.: US 7,001,225 B2
(45) Date of Patent: Feb. 21, 2006

(54) CONNECTOR

(75) Inventor: Masaya Horiuchi, Yokkaichi (JP)

(73) Assignee: Sumitomo Wiring Systems, Ltd., (JP)

( * ) Notice: Subject to any disclaimer, the term of this patent is extended or adjusted under 35 U.S.C. 154(b) by 0 days.

(21) Appl. No.: 11/022,980

(22) Filed: Dec. 27, 2004

(65) Prior Publication Data

US 2005/0142955 A1 Jun. 30, 2005

(30) Foreign Application Priority Data

Dec. 25, 2003 (JP) ..... 2003-430300

(51) Int. Cl.
*H01R 13/514* (2006.01)

(52) U.S. Cl. ..... 439/752; 439/595

(58) Field of Classification Search ..... 439/595, 439/596, 752

See application file for complete search history.

(56) References Cited

U.S. PATENT DOCUMENTS 5,378,176 A * 1/1995 Sasai ..... 439/752
5,647,777 A 7/1997 Sasai et al.
5,651,703 A * 7/1997 Sasai ..... 439/752
6,139,375 A * 10/2000 Konoya et al. ..... 439/752
6,497,591 B1 * 12/2002 Fujita ..... 439/752
6,599,154 B1 * 7/2003 Sakurai et al. ..... 439/752
6,702,627 B1 * 3/2004 Nankou et al. ..... 439/752
6,811,452 B1 * 11/2004 Fujita et al. ..... 439/752

* cited by examiner

*Primary Examiner*—Thanh-Tam Le
(74) *Attorney, Agent, or Firm*—Gerald E. Hespos; Anthony J. Casella

(57) ABSTRACT

A retainer (30) including a pair of side plates (32) is mounted such that the retainer (30) crosses over a housing (10) along width direction and the side plates (32) bulge out along width direction from side surfaces of the housing (10). Protection walls (27, 28) are formed on the side surfaces of the housing (10) to project around movable ranges of the side plates (32) of the retainer (30). Thus, inadvertent movement of the retainer (30) due to the contact of an external matter with the side plates (32) can be prevented. The protection walls (27, 28) are formed to define jig insertion holes (29). Thus, the side plates (32) of the retainer (30) can be disengaged from a full locking position by inserting a jig (J) through the jig insertion holes (29).

12 Claims, 9 Drawing Sheets

CONNECTOR

BACKGROUND OF THE INVENTION

1. Field of the Invention

The present invention relates to a connector with a retainer.

2. Description of the Related Art

U.S. Pat. No. 5,647,777 discloses a connector with a retainer. This connector has a housing formed with cavities for accommodating terminal fittings and a retainer for retaining the terminal fittings. Two side plates are disposed at the opposite respective sides of the retainer and the retainer is mounted to cross over a rear part of the housing along the width direction. The retainer is movable in a direction oblique to an inserting direction of the terminal fittings. The retainer can be held at a partial locking position where the insertion and withdrawal of the terminal fittings into and from the cavities are permitted and a full locking position where the terminal fittings are retained by the engagement with the retainer.

A cross-sectional area of the fitted portion of the retainer sometimes is desired to be as small as possible due to a request for miniaturization. Accordingly, the outer shape of the housing is made relatively small and the retainer is arranged at a rear part of the housing which is not fit into the receptacle. Additionally, the side plates of the retainer bulge out wider than the side surfaces of the housing.

The above-described retainer may be moved inadvertently when external matter or the like contacts the side plates of the retainer that bulge out from the side surfaces of the housing. The retainer then needs to be returned to an initial position, thereby wasting time and causing inconvenience.

The invention was developed in view of the above problem and an object thereof is to provide a connector having an improved overall operability, particularly capable of preventing a retainer from being inadvertently moved.

SUMMARY OF THE INVENTION

The invention relates to a connector that has a housing formed with at least one cavity for accommodating at least one terminal fitting. The connector also includes a retainer that is mountable to cross over the housing substantially along a width direction, which is substantially normal to an inserting direction of the terminal fitting into the cavity. The retainer is movable in a direction intersecting an inserting direction of the terminal fitting between a partial locking position and a full locking position. The terminal fitting can be inserted into the cavity and withdrawn from the cavity when the retainer is at the partial locking position. However, the terminal fitting is locked in the cavity when the retainer is at the full locking position. The retainer has side plates that bulge out from side surfaces of the housing. Protection walls are formed on the side surfaces of the housing and project at least partly around movable ranges of the side plates. Thus, external matter is not likely to contact the retainer and generate an inadvertent movement of the retainer.

The protection walls preferably are arranged at substantially opposite sides of the movable range of each side plate with respect to a moving direction of the side plate. Thus, the protection wall prevent movement of the retainer from the partial locking position to the full locking position and movement of the retainer from the full locking position to the partial locking position.

The protection walls preferably are cut or recessed to form at least one jig insertion hole for receiving a jig for disengaging the side plates of the retainer from the full locking position.

At least one guide preferably is provided on the protection wall to guide the jig to a substantially proper position by inserting the leading end of the jig substantially along the guide.

The side plates preferably are substantially in surface contact with the protection walls when the retainer is at the partial locking position.

The retainer preferably is moved in its moving direction while the respective side plates are held substantially in sliding contact with guide ribs and/or sliding contacts of the protection walls.

A projecting height of the protection walls preferably is about equal to the thickness of the side plates.

Outer surfaces of the side plates and outer surfaces of the protection walls preferably are substantially flush with the each other when the retainer is at the full locking position.

At least one retainer holding portion preferably bulges out along the width direction from the side surfaces of the housing and at least one holding recesses is formed in the outer side surfaces thereof. The holding recesses define the movable ranges of the retainer.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

A connector according to the invention is described with reference to FIGS. 1 to 10. The connector has a housing 10 that is connectable with a mating housing 40. In the following description, a side (left side in FIG. 1) of the connector to be connected in a connecting direction CD with a mating male connector 40 (see FIG. 3) is referred to as the front. Additionally, the terms up and down are used herein for a convenient frame of reference, and do not imply a required gravitational orientation.

Figure 1:
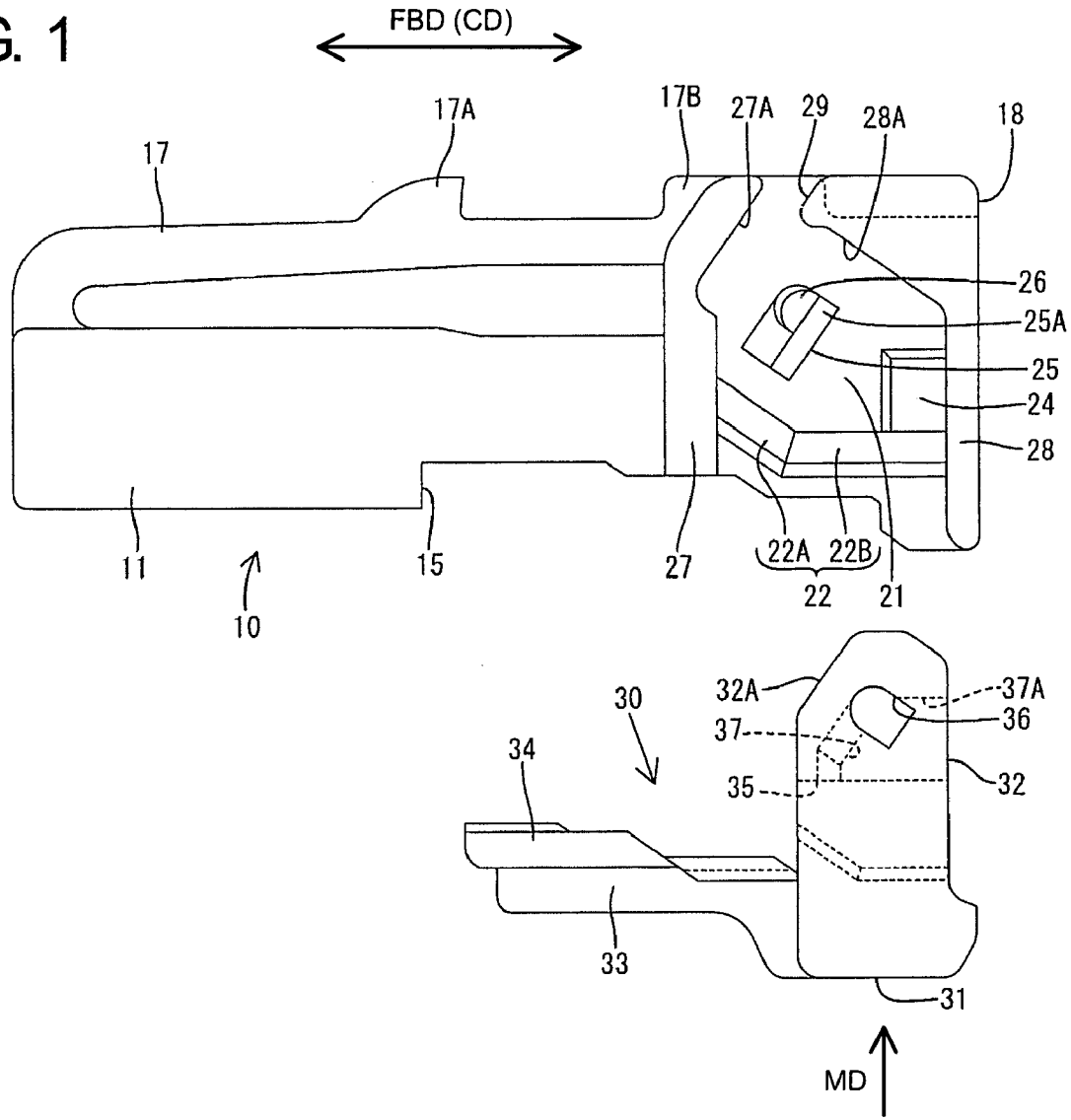
FIG. 1 is an exploded side view of a connector according to one embodiment of the invention.
Figure 2:
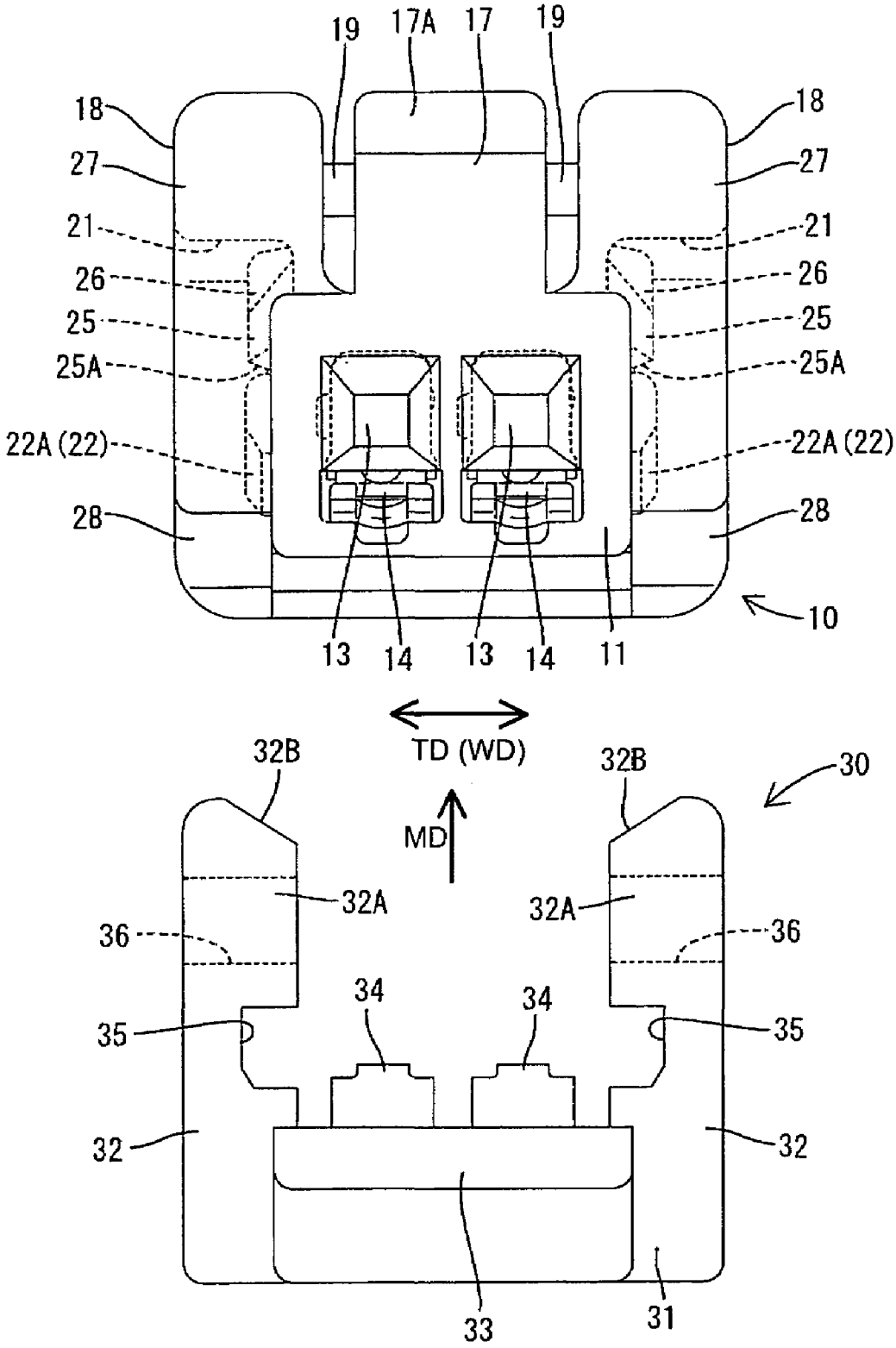
FIG. 2 is an exploded front view of the connector.
Figure 7:
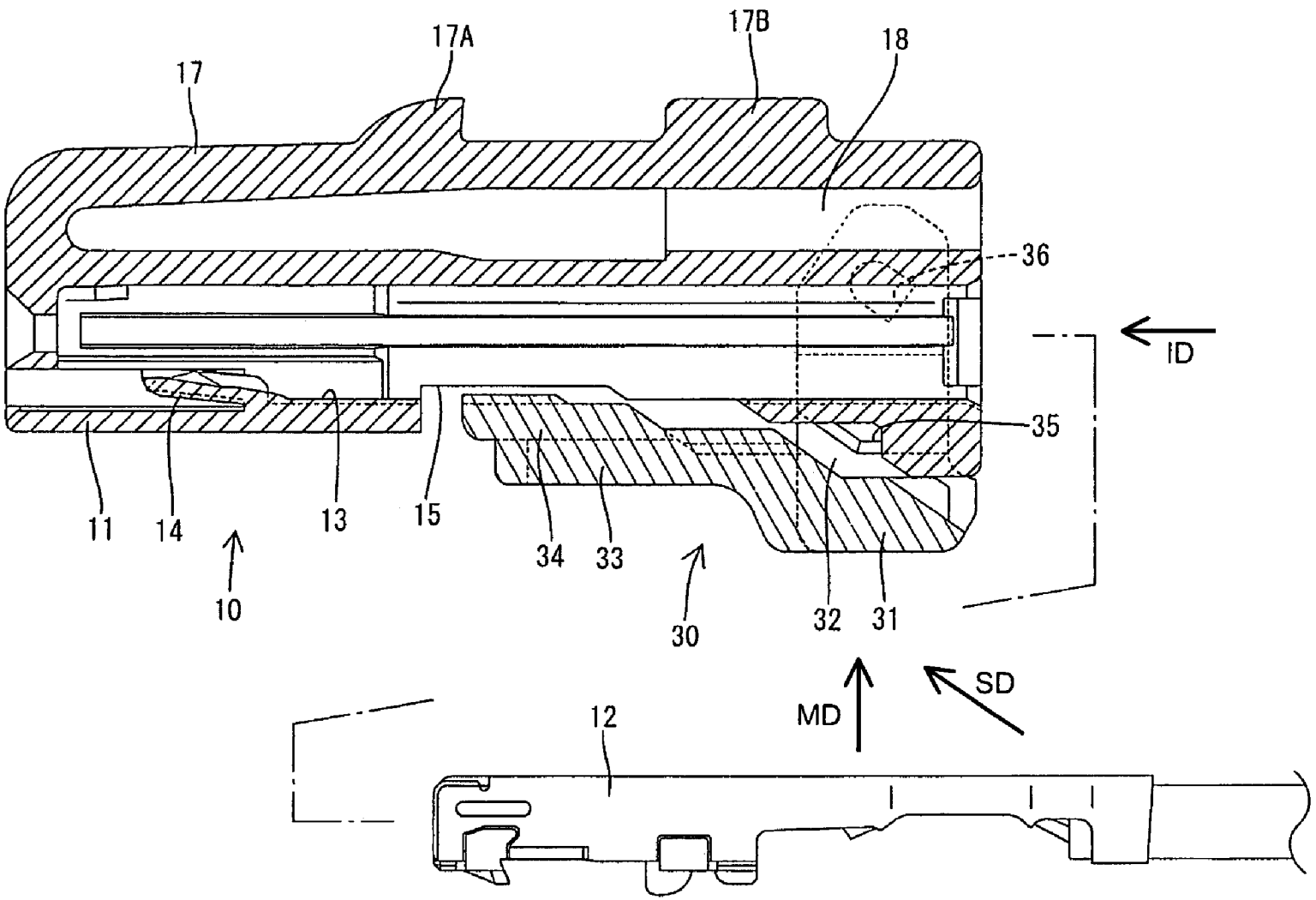
FIG. 7 is a side view in section showing the state where the retainer is mounted at the partial locking position.

The housing 10 is made e.g. of a synthetic resin and includes a main body 11 substantially in the form of a box that is narrow and long in forward and backward directions FBD. Left and right cavities 13 are formed in the main body 11, as shown in FIGS. 2 and 7. The cavities 13 are hollow in forward and backward directions FBD, and female terminal fittings 12 are inserted into the respective cavities 13 in an inserting direction ID through openings at the rear side. Male terminal fittings (not shown) project from the mating connector 40 and are through openings at the front of the cavities 13 for connection with the female terminal fittings 12. A lock 14 is cantilevered obliquely forward from a position on the bottom wall of each cavity 13 close to the front end. The lock 14 is resiliently deformable in a substantially vertical direction that is substantially normal to the inserting direction ID of the terminal fittings 12 into the cavities 13. The lock 14 is engageable with the female terminal fitting 12 to retain the female terminal fitting 12. An insertion hole 15 is so formed in the bottom surface of the main body 11 and communicates with the cavities 13.

A lock arm 17 extends back from the front end of the upper surface of the main body 11. Two retainer holders 18 project up from the left and right sides of the rear end of the main body 11, and the rear end of the lock arm 17 is held between the left and right retainer holders 18. Thin resilient deforming pieces 19 extend to the left and right from substantially side surfaces at the rear end of the lock arm 17, and ends of the deforming pieces 19 are coupled unitarily to the inner side surfaces of the retainer holders 18. In this way, the lock arm 17 has the front end thereof coupled to the front end of the housing main body 11 while the rear end is coupled to the retainer holding portions 18 via the pair of deforming pieces 19. Thus, the lock arm 17 is supported at both ends and is resiliently displaceable vertically towards and away from the main body 11 and in a direction intersecting the connecting direction CD.

Figure 3:
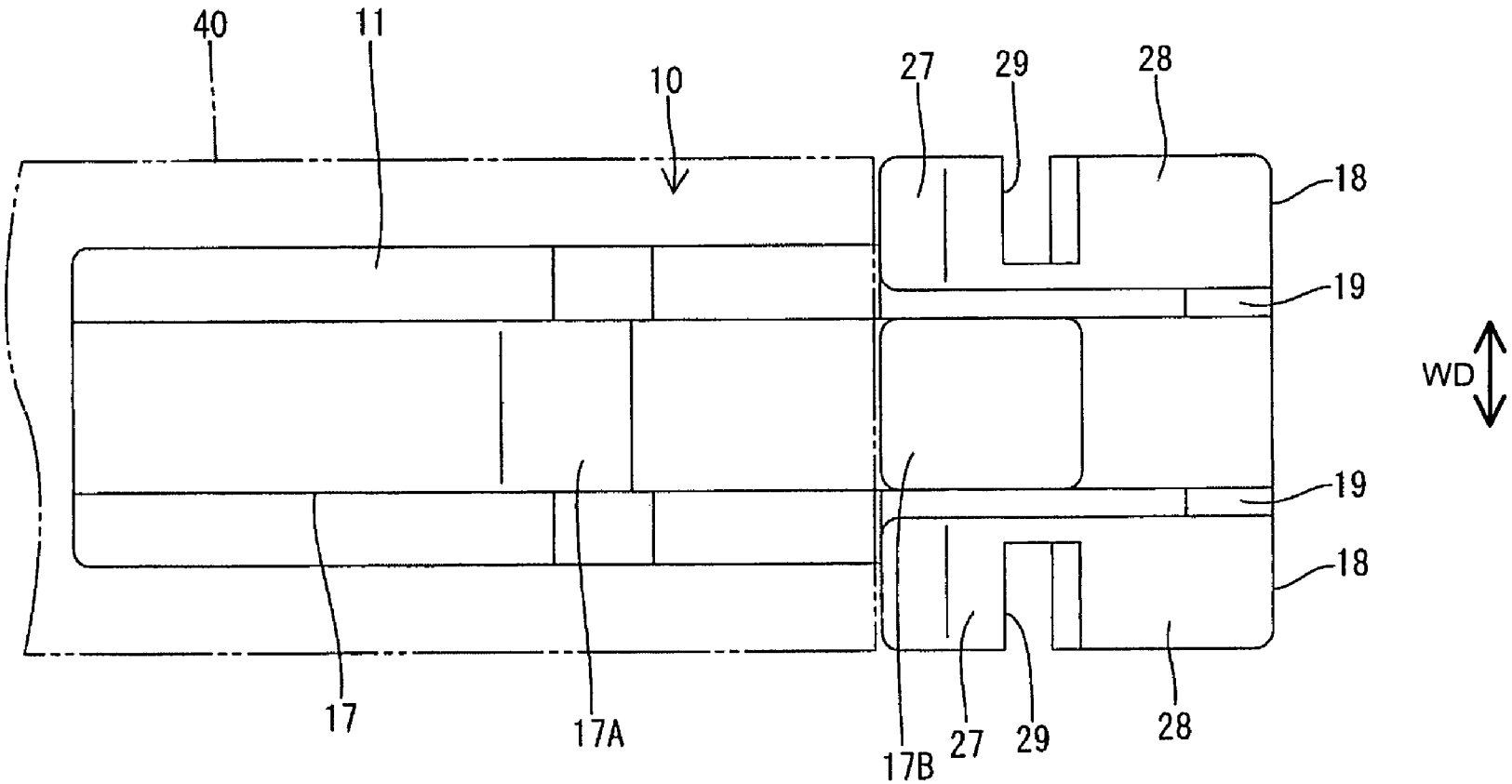
FIG. 3 is a plan view of a housing.
Figure 4:
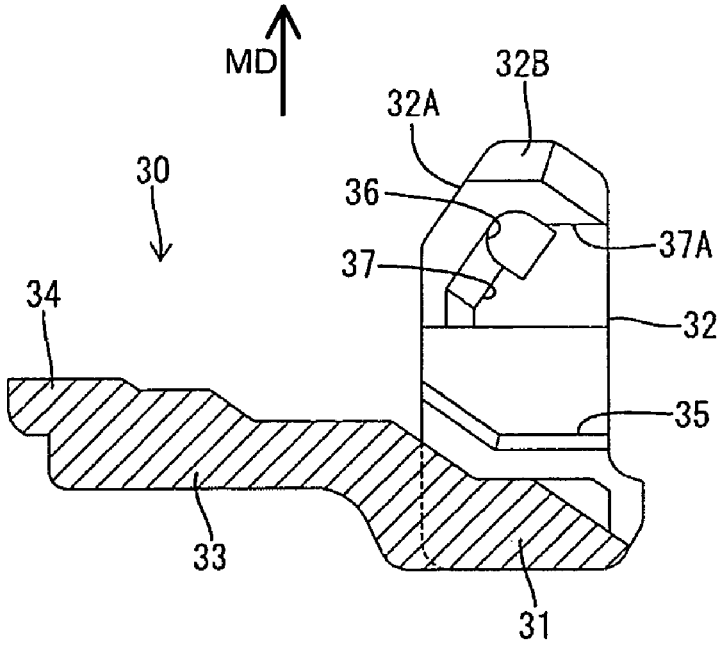
FIG. 4 is a side view in section of a retainer.
Figure 5:
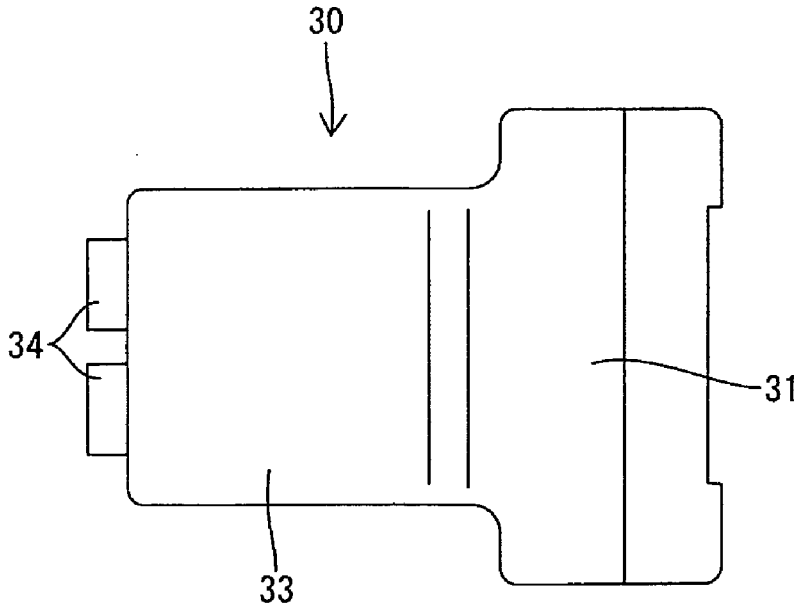
FIG. 5 is a bottom view of the retainer.

A part of the housing 10 before the retainer holders 18 can be received in a receptacle of the male connector 40, as shown in FIG. 3. The height and width of a front part of the main body 11 that fit into the male connector 40 are smaller than the corresponding dimensions of the rear part of the housing 10 that are not fit into the male connector 40. A lock projection 17A projects at a substantially longitudinal middle of the upper surface of the lock arm 17 and is engageable with the mating male connector 40. An unlocking projection 17B projects up at a position on the lock arm 17 before the deforming pieces 19 and between the retainer holders 18 (i.e. position to be located outside the male connector 40). A downward pressing force on the unlocking projection 17B will deform the lock arm 17 down to disengage the lock projection 17A from the male connector 40.

The connector also includes a retainer 30 made e.g. of a synthetic resin. The retainer 30 has a plate-shaped coupling 31 that extends along a transverse direction TD, as shown in FIGS. 1, 2, 4 and 5. Two side plates 32 extend up towards the main body 11 from opposite ends of the coupling 31. The side plates 32 are resiliently deformable towards and away from each other along the transverse direction TD. A substantially plate-shaped extension 33 extends forward from the front surface of the coupling 31, and retaining projections 34 project from the upper surface of the extension 33. The retaining projections 34 are narrow and long in forward and backward directions FBD.

The retainer holding portions 18 bulge out in the width direction WD from the side surfaces of the main body 11 and project up from the upper surface of the main body 11. Holding recesses 21 are formed in the outer side surfaces of the retainer holding portions 18. The retainer 30 is mounted from below substantially normal to the forward and backward directions FBD and crosses the housing 10 substantially along the width direction WD. The side plates 32 bulge out along the width direction WD from the side surfaces of the main body 11 and fit partly into the left and right holding recesses 21. A guide rib 22 projects at a bottom part of each holding recess 21. Each guide rib 22 has an inclined front portion 22A and a horizontal rear portion 22B. The front portion 22A is inclined up towards the front at an angle that preferably is between about 10° and 55°. The rear portion 22B extends substantially in the forward and backward directions FBD. The bottom edge of each guide rib 22 is slanted. On the other hand, downwardly sloped slanted surfaces 32B are formed at the upper ends of the side plates 32 of the retainer 30. The slanted surfaces cooperate so that the side plates 32 can be fit to the retainer holding portions 18 more easily.

Grooves 35 are formed on the inner surfaces of the side plates 32 of the retainer 30 close to the coupling 31 and are configured to receive the guide ribs 22. Each groove 35 has an upper edge that extends substantially horizontally along the forward and backward directions FBD. A front portion of the bottom edge of each groove 35 is inclined up and forward at substantially the same angle as the inclined portion 22A of the guide rib 22. A rear portion of the bottom edge of each groove 35 extends substantially horizontally in forward and backward directions FBD. The front end of the groove 35 has a width measured along a mounting direction MD for closely receiving the inclined portion 22A of the guide rib 22. Thus the retainer 30 is held on the housing 10 by fitting the guide ribs 22 into the grooves 35. More particularly, the retainer 30 is mountable to the housing 10 in the mounting direction MD and is slidable in a sliding direction SD substantially parallel to the inclined portions 22A.

Figure 6:
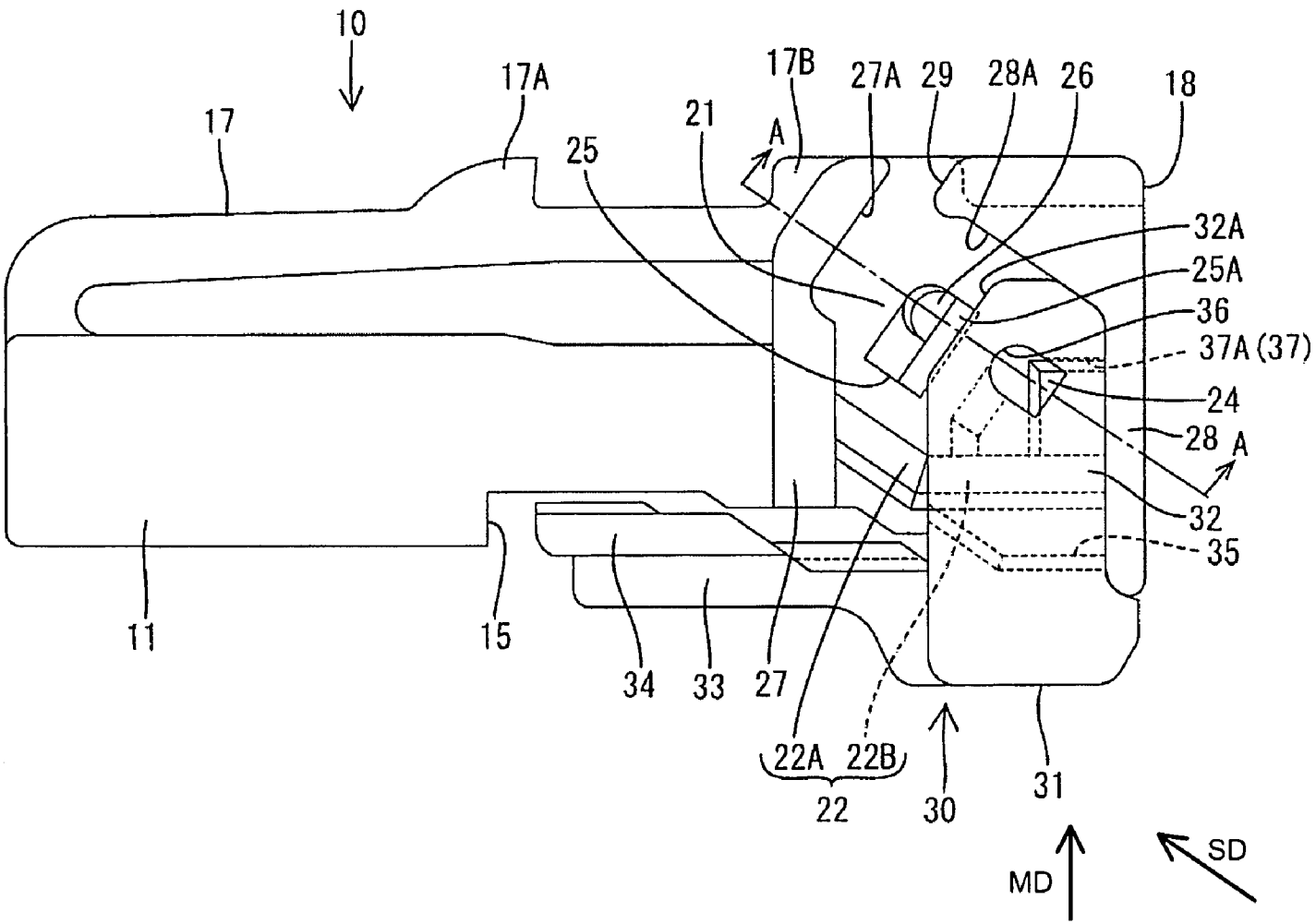
FIG. 6 is a side view showing a state where the retainer is mounted at a partial locking position.

The retainer 30 can be held at a partial locking position at the rear end of the movable range and at a full locking position at the front end of the movable range. The upper edges of the horizontal portions 22B of the guide ribs 22 contact the upper edges of the grooves 35, as shown in FIGS. 6 and 7, when the retainer 30 is at the partial locking position. Further, the retaining projections 34 are retracted from the cavities 13 at this partial locking position to permit insertion and withdrawal of the female terminal fittings 12 into and from the cavities 13.

Figure 10A:
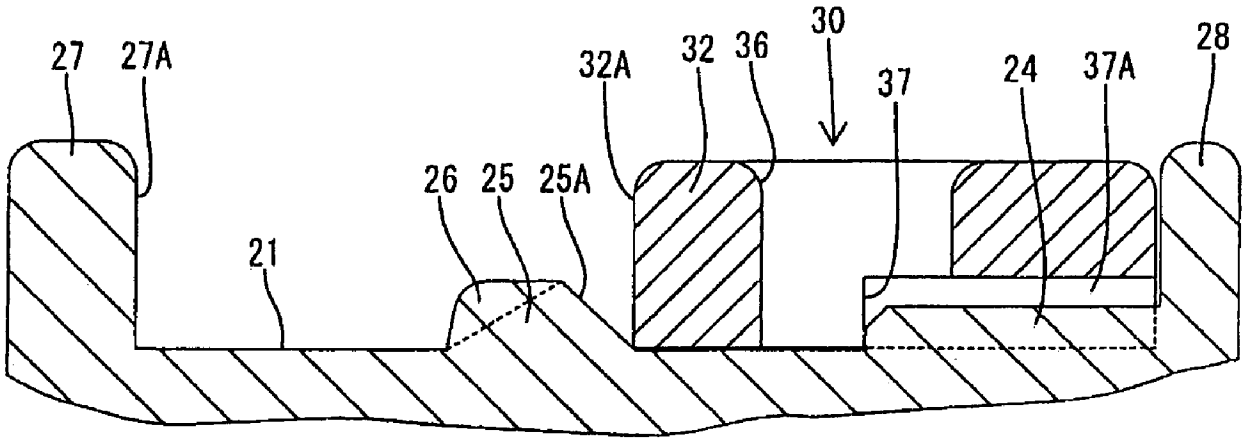
FIGS. 10(A) and 10(B) are a section along 10A—10A of FIG. 6 and a section along 10B—10B of FIG. 8.

A substantially rectangular step 24 is formed above the horizontal portion 22B of the guide rib 22 at the rear side of each holding recess 21. On the other hand, a long narrow escaping recess 37 extends in the forward and backward directions FBD on the inner surface of each side plate 32 of the retainer 30. The escaping recess 37 is shallower than the groove 35 and is more toward the leading end than the groove 35. The steps 24 are accommodated in the escaping recesses 37 and upper edges 37A of the escaping recesses 37 engage the upper edges of the steps 24 when the retainer 30 is at the partial locking position, as shown in FIGS. 6 and 10(A). Thus, the posture of the retainer 30 at the partial locking position is stabilized, and the retainer 30 will not incline e.g. in a clockwise direction of FIG. 6 when an external force is exerted on the retainer 30.

Figure 8:
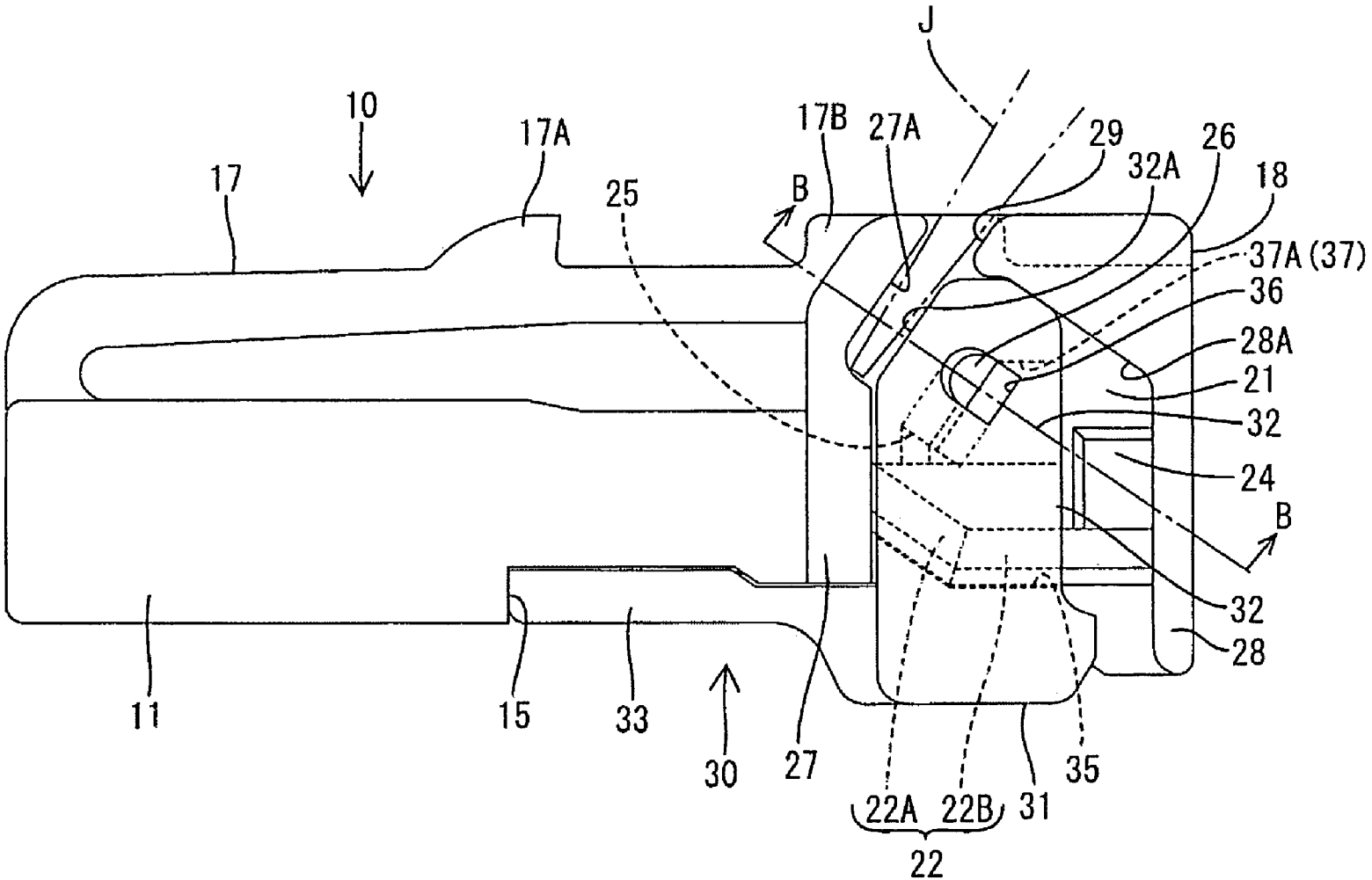
FIG. 8 is a side view showing a state where the retainer is mounted at a full locking position.
Figure 9:
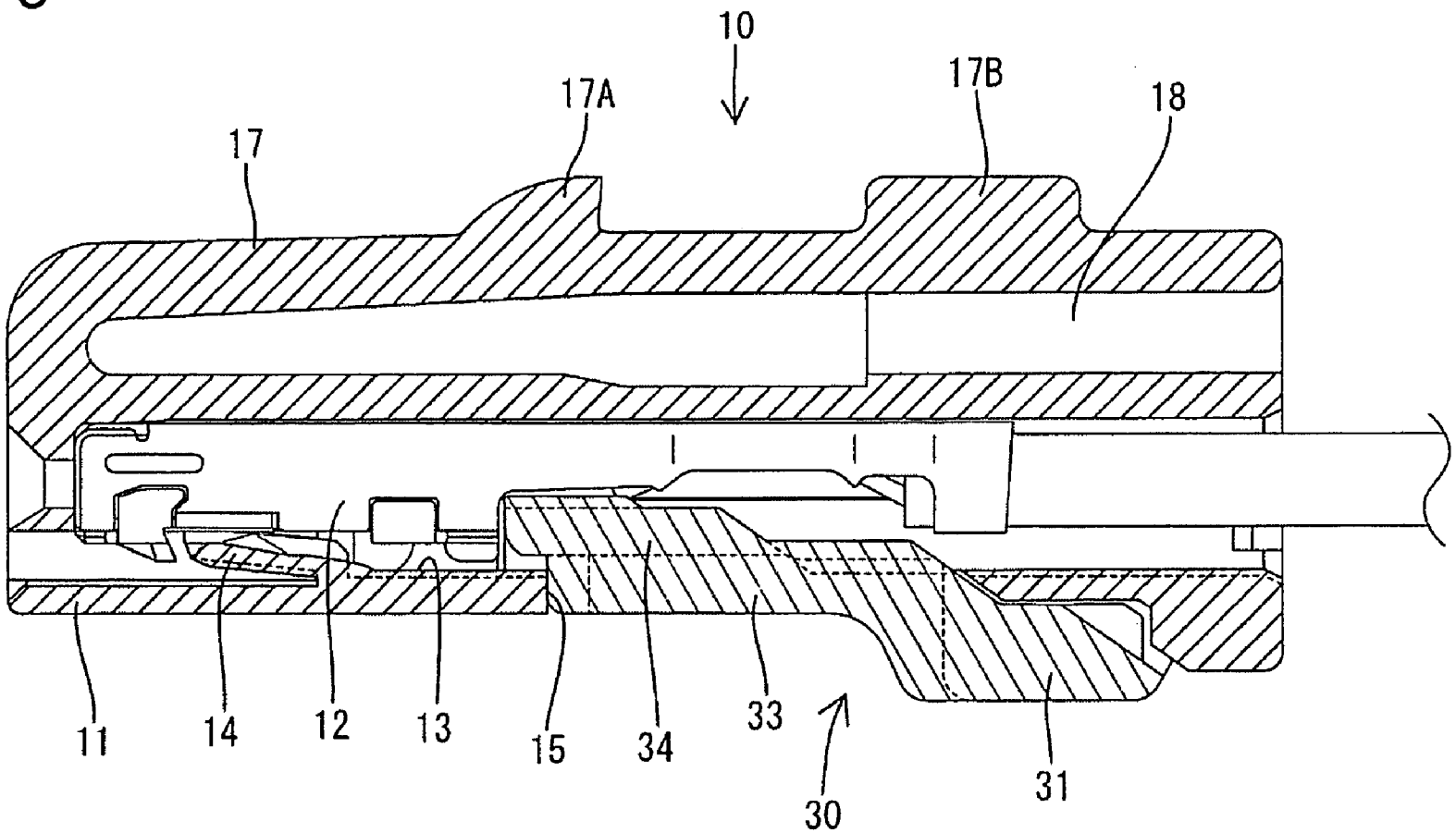
FIG. 9 is a side view in section showing the state where the retainer is mounted at the full locking position.

The bottom edges of the inclined portions 22A and the bottom edges of the horizontal portions 22B of the guide ribs 22 contact the bottom edges of the grooves 35 when the retainer 30 is at the full locking position as shown in FIGS. 8 and 9. Thus, the retaining projections 34 of the retainer 30 enter the respective cavities 13 from the insertion hole 15 to engage the female terminal fittings 12. As a result, the female terminal fittings 12 are locked doubly.

Figure 10B:
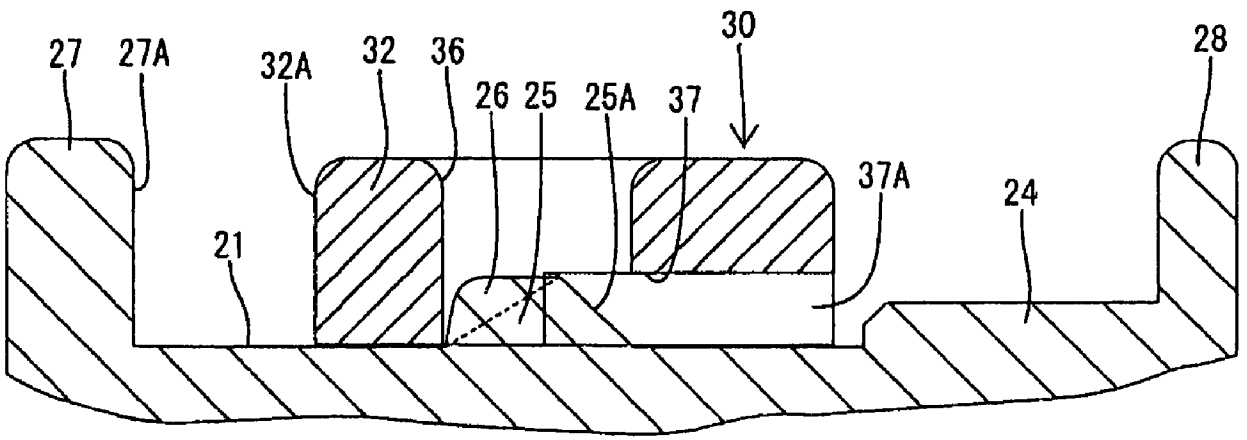

An oblique portion 32A is formed at a front upper side of each side plate 32 of the retainer 30 and is aligned substantially normal to both the inclined portion 22A of the guide rib 22 and the sliding direction SD. On the other hand, a rib 25 is formed in the holding recess 21. The rib 25 has a substantially triangular cross section and extends substantially normal to both the inclined portion 22A of the guide rib 22 and the sliding direction SD. The rib 25 has a slanted rear surface 25A that is higher toward the front along a sliding direction SD of the retainer 30 and extends substantially along the oblique portion 32A of the side plate 32 when the retainer 30 is at the partial locking position. A locking projection 26 is formed at an upper side of the front surface of the rib 25 and has substantially the same height as the tip of the rib 25. A lock hole 36 penetrates each side plate 32 of the retainer 30. As shown in FIG. 10(B), the locking projections 26 engage the lock holes 36 and the ribs 25 enter the escaping recesses 37 when the retainer 30 is at the full locking position.

A front protection wall 27 and a rear protection wall 28 project substantially around the holding recess 21 in each of the left and right retainer holding portions 18 and substantially surround the front, rear and upper sides of the side plate 32 of the retainer 30 in the holding recess 21. The projecting height of each protection walls 27, 28 in the width direction WD preferably is about equal to the thickness of the side plates 32. Thus, the outer surfaces of the side plates 32 and the protection walls 27, 28 are substantially flush with the each other when the retainer 30 is at the full locking position. The front protection walls 27 are before the holding recesses 21, and lower parts of the front protection walls 27 extend substantially along the front edges of the side plates 32 when the retainer 30 is at the full locking position. The rear protection walls 28 are behind the holding recesses 21, and lower parts of the rear protection walls 28 extend along the rear edges of the side plates 32 when the retainer 30 is at the partial locking position. Thus, the protection walls 27 and 28 define the movable range of the retainer 30 Sliding contacts 28A are formed at upper parts of the rear protection walls 28 and are substantially parallel with the inclined portions 22A of the guide ribs 22. Upper ends of the side plates 32 are held in sliding contact with the sliding contacts 28A when the retainer 30 is moved between the partial locking position and the full locking position.

A space is defined between the two protection walls 27 and 28 above the holding recess 21 of each retainer holding portion 18 to form a jig insertion hole 29 for receiving a jig J (see FIG. 8). Further, a guide 27A is formed at an upper part of each front protection wall 27. The guide 27A is aligned substantially normal to the inclined portion 22A of the guide rib 22 and is substantially continuous with the back side of the jig insertion hole 29. The jig J can be inserted toward the back side through the jig insertion hole 29 along the guide 27A in an oblique posture substantially parallel with the side surface of the main body 11 and inclined down toward the front end.

The retainer 30 is first mounted in the mounting direction MD to the partial locking position on the housing 10 (see FIGS. 6 and 7). As a result, the protection walls 27, 28 partly surround the side plates of the retainer 30. The rear surfaces of the side plates 32 are substantially in surface contact with the rear protection walls 28 when the retainer 30 is at the partial locking position. Thus, the side plates 32 cannot be contacted by external matter or the like in a way that could move the retainer 30 inadvertently towards the full locking position. The female terminal fittings 12 are inserted into the respective cavities 13 of the housing 10 from behind and along the inserting direction ID while the retainer 30 is at the partial locking position. As a result, the female terminal fittings 12 contact and deform the respective locks 14 during the insertion process. Each lock 14 is restored resiliently when the female terminal fitting 12 is inserted to a proper depth. Thus, the locks 14 retain the female terminal fittings 12.

The coupling 31 then is pushed to slide the retainer 30 in the sliding direction SD obliquely up to the front substantially along the inclined portions 22A of the guide ribs 22. The oblique portions 32A of the side plates 32 slide in contact with the slanted surfaces 25A of the respective ribs 25. Thus, the respective side plates 32 deform resiliently in opening directions to move onto the locking projections 26. The retainer 30 is moved farther in the sliding direction SD while the side plates 32 slide in contact with both the inclined portions 22A of the respective guide ribs 22 and the sliding contacts 28A of the rear protection walls 28. The side plates 32 are restored resiliently in closing directions and achieve surface contact with the bottom surfaces of the respective holding recesses 21 when the retainer 30 reaches the full locking position. Thus, the locking projections 26 engage the lock holes 36 (see FIGS. 8 and 10). Further, the retaining projections 34 enter the respective cavities 13 to engage and doubly lock the female terminal fittings 12. The protection walls 27, 28 substantially surround the side plates 32 of the retainer 30 and the front surfaces of the side plates 32 are substantially in surface contact with the front protection walls 27. Thus, external matter or the like cannot contact the side plates 32 in a way that would move the retainer 30 inadvertently to the partial locking position.

The female terminal fittings 12 may have to be removed from the completely assembled connector for maintenance or other reason. Thus, the jig J is inserted into the jig insertion hole 29 in a posture substantially parallel with the side surface of the main body 11 and inclined down towards the front as shown in FIG. 8. The jig J is guided to a proper position by inserting the leading end of the jig J to the back side along the guide 27A of the front protection wall 27. The jig J then is turned with force in a direction to bring the leading end back (counterclockwise in FIG. 8) about a position near the jig insertion hole 29. Thus, the leading end of the jig J contacts the oblique portion 32A of the side plate 32 to lift the side plate 32 from the bottom surface of the holding recess 21. In this way, the locking projection 26 is disengaged from the lock hole 36. The retainer 30 is moved back with the locking projections 26 and the lock holes 36 disengaged from each other and is returned to the partial locking position. The retaining projections 34 of the retainer 30 are disengaged from the female terminal fittings 12 in this way, and the female terminal fittings 12 can be withdrawn from the cavities 13.

As described above, inadvertent movement of the retainer 30 toward the partial locking position due to the contact of an external matter with the side plates 32 can be prevented since the protection walls 27, 28 project around the movable ranges of the side plates 32 of the retainer 30 at the side surfaces of the housing 10.

The protection walls 27, 28 are at the opposite sides of the movable range of the retainer 30 with respect to the sliding direction SD of the retainer 30. Thus, inadvertent movement of the retainer 30 from the partial locking position to the full locking position and from the full locking position to the partial locking position is prevented.

The protection walls 27, 28 are cut off or recessed to form the jig insertion holes 29. Thus, the side plates 32 of the retainer 30 can be disengaged from the full locking position by inserting the jig J through the jig insertion holes 29.

The invention is not limited to the above described and illustrated embodiment. For example, the following embodiments are also embraced by the technical scope of the present invention as defined by the claims. Beside the following embodiment, various changes can be made without departing from the scope and spirit of the present invention as defined by the claims.

Although the protection walls cover the front, rear and upper sides of the side plates in the foregoing embodiment, they may cover, for example, only the front and rear sides or only the upper sides of the side plates according to the invention. Further, the jig insertion holes may be dispensed with.

The retainer is moved in the sliding direction SD oblique to the inserting and withdrawing directions ID of the female terminal fittings in the foregoing embodiment. However, the invention is also applicable to connectors in which a retainer is moved substantially normal to inserting and withdrawing directions of the terminal fittings.

The connector has left and right cavities in the foregoing embodiment. However, the invention is also applicable to connectors having cavities arranged at a plurality of stages.

A female connector is illustrated in the foregoing embodiment. However, the invention also is applicable to male connectors with male terminal fittings.

What is claimed is:

1. A connector, comprising:

a housing formed with at least one cavity for accommodating a terminal fitting, and a retainer including a pair of side plates at opposite sides and mountable so that the retainer crosses over the housing along a width direction, the side plates bulging out along the width direction from side surfaces of the housing, wherein:

the retainer is movable in a moving direction intersecting an inserting direction of the terminal fitting from a first position where insertion and withdrawal of the terminal fitting into and from the cavity are permitted and a second position where the terminal fitting is retained by engagement with the retainer, and protection walls are formed on the side surfaces of the housing to project at least partly around movable ranges of the side plates, wherein portions of the protection walls substantially opposed to a leading end of the retainer with respect to the moving direction are formed to define a jig insertion hole for receiving a jig to urge the side plates substantially opposite to the moving direction and to disengage the side plates of the retainer from the second position.

2. The connector of claim 1, wherein the protection walls are arranged at the substantially opposite sides of the movable range of each side plate with respect to the moving direction of the side plate.

3. The connector of claim 1, wherein a guiding portion is provided on the protection walls for guiding the jig to a substantially proper position.

4. The connector of claim 1, wherein surfaces of the side plates are substantially in surface contact with the protection walls when the retainer is at the first position.

5. The connector of claim 1, wherein the retainer is moved in the moving direction while the respective side plates are held substantially in sliding contact with guide ribs and sliding contacts of the protection walls.

6. The connector of claim 1, wherein a projecting height of the protection walls is about equal to a thickness of the side plates.

7. The connector of claim 1, wherein outer surfaces of the side plates and the protection walls are substantially flush with each other when the retainer is at the second position.

8. The connector of claim 1, wherein retainer holding portions bulge out substantially along the width direction from the side surfaces of the housing and holding recesses are formed in the outer side surfaces thereof, the holding recesses defining the movable ranges of the retainer.

9. The connector of claim 1, wherein the housing has opposite front and rear ends, and the cavity extending between the ends, the protection walls including a front protection wall between the retainer and front end of the housing, a rear protection wall between the retainer and the rear end of the housing and a leading protection wall substantially opposed to the leading end of the retainer, the jig insertion hole being formed in the leading protection wall.

10. The connector of claim 9, wherein the jig insertion hole is aligned to receive a jig along a direction oblique to the inserting direction of the terminal fitting.

11. A connector, comprising:

a housing with opposite front and rear ends and at least one cavity extending between the ends for accommodating a terminal fitting, the housing having a retainer insertion wall extending rearward from the front end and sidewalls extending angularly from the front wall and from the retainer insertion wall, an insertion hole extending into the retainer insertion wall and communicating with the cavity, portions of the housing adjacent the front end being configured for insertion into a receptacle of a mating housing;

a retainer having a bridge, at least one retaining projection extending from the bridge and being insertable into the insertion hole, side plates extending from the bridge and being slidable along the sidewalls of the housing in proximity to the rear end of the housing, the retainer being movable in a moving direction transverse to an inserting direction of the terminal fitting from a first position where insertion and withdrawal of the terminal fitting into and from the cavity are permitted and a second position where the terminal fitting is retained by the retaining projection;

protection walls projecting out from the side surfaces of the housing at least partly around movable ranges of the side plates and at locations reward of portions of the housing that are insertable into the receptacle of the mating housing, at least one of said protection walls being formed with a jig insertion hole for receiving a jig to urge the side plates substantially opposite to the moving direction for moving the retainer from the second position to the first position.

12. A connector, comprising:

a first housing having a front end, external surfaces extending rearward from the front end and a receptacle extending into the front end, at least one first terminal disposed in the receptacle;

a second housing with opposite front and rear ends and at least one cavity extending between the ends for accommodating a second terminal fitting, the second housing having walls extending rearward from the front end, an insertion hole extending into one of said walls and communicating with the cavity, portions of the second housing adjacent the front end being configured for insertion into the receptacle;

a retainer having a retaining projection insertable into the insertion hole for retaining the second terminal fitting in the cavity, the retainer further having side plates slidably engaged on two of the walls of the second housing externally of the receptacle, the side plates having outer surfaces aligned substantially flush with the external surfaces of the first housing;

protection walls projecting out from the second housing and at least partly surrounding the side plates of the retainer, the protection walls having outer surfaces substantially flush with the outer surfaces of the side plates and the external surfaces of the first housing, the protection walls having at least one jig insertion hole for receiving a jig for urging said retainer into a position for permitting insertion and removal of the second terminal fitting into and from the cavity.

* * * * *